US006668392B2

(12) United States Patent
Mason

(10) Patent No.: US 6,668,392 B2
(45) Date of Patent: Dec. 30, 2003

(54) ENCLOSURE FOR PORTABLE TOILET

(76) Inventor: Michael Mason, 3807 Southern Manor Dr., St. Louis, MO (US) 63125

( * ) Notice: Subject to any disclaimer, the term of this patent is extended or adjusted under 35 U.S.C. 154(b) by 0 days.

(21) Appl. No.: 10/144,582

(22) Filed: May 13, 2002

(65) Prior Publication Data

US 2003/0208838 A1 Nov. 13, 2003

(51) Int. Cl.[7] ..... A47K 11/02

(52) U.S. Cl. ..... 4/449; 4/462; 4/476; 52/143; 52/264

(58) Field of Search ..... 4/449, 462, 463, 4/476–479; 52/143, 264, 282, 38, 73, 3, 5; D23/270

(56) References Cited

U.S. PATENT DOCUMENTS

| | | | | | |
|---|---|---|---|---|---|
| 2,870,558 | A | * | 1/1959 | Fuller | 40/538 |
| 3,066,311 | A | * | 12/1962 | Tharp | 4/462 |
| 4,065,885 | A | | 1/1978 | Blick, III et al. | |
| 4,577,351 | A | | 3/1986 | Harding | |
| 4,744,111 | A | * | 5/1988 | Tegg et al. | 4/460 |
| 4,918,765 | A | | 4/1990 | Harding | |
| 5,398,465 | A | * | 3/1995 | Tagg | 52/79.1 |
| 5,561,930 | A | * | 10/1996 | Ashley et al. | 40/538 |
| 5,682,622 | A | * | 11/1997 | Tagg | 4/449 |
| 6,148,553 | A | * | 11/2000 | Billet | 40/538 |
| D452,901 | S | * | 1/2002 | Wieringa | D23/299 |
| 6,349,426 | B1 | | 2/2002 | Wieringa | |
| D460,539 | S | * | 7/2002 | Lundstrom | D23/302 |
| 6,418,672 | B1 | * | 7/2002 | Hampel | 52/79.1 |

OTHER PUBLICATIONS

Picture of "Beer Can" shaped portable toilets.

* cited by examiner

*Primary Examiner*—Gregory L. Huson
*Assistant Examiner*—Azy Kokabi
(74) *Attorney, Agent, or Firm*—Polster, Lieder, Woodruff & Lucchesi, L.C.

(57) ABSTRACT

An enclosure for a portable toilet comprises at least two sections, one of which has a door opening and a door mounted thereon. The enclosure door is moveable between a closed position and an opened position. Each enclosure section includes a first end and a second end. A tab having a hole extends from the first and a hole is formed in the second end of each enclosure section. When assembled, the first end of one section abuts the second end of the adjacent section. To ensure a substantially smooth seam or junction between the two sections, the tab extends from the inner surface of one section, across the junction between the two sections, to lie against the inner surface of the adjacent section. The tabs are aligned with the holes, and are sized such that the tab holes align with the section holes. A fastener is passed through the section hole and the tab hole to secure the two sections together. Mounting tabs are also provided at the bottom of the enclosure to secure the enclosure to the base. This will positionally fix the enclosure relative to the toilet to maintain alignment of the enclosure door with the door of the portable toilet. The enclosure can also be provided with a top portion to give the enclosure an overall shape of a beverage bottle.

20 Claims, 3 Drawing Sheets

ENCLOSURE FOR PORTABLE TOILET

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to covers or enclosures for portable toilets, and, in particular, to an enclosure which is easy to assemble and which can allow for the use of advertising graphics on the outside surface of the enclosure.

Portable toilets are commonly used at fairs, festivals etc., when there is a need to create a temporary bathroom facilities. The portable toilets are generally rectangular in shape, and, as a whole, are not very aesthetically pleasing.

To correct for this, others have developed portable toilets which are cylindrical in shape, and have a surface on which graphics can be printed. However, such portable toilets are expensive to produce, must comply with applicable regulations, and do not take into consideration the fact that there is a large number of previously manufactured portable toilets which it would be desirable to enclose.

It would thus be desirable to provide a decorative enclosure for the portable toilet which would make the fair grounds more attractive, or which could be used for advertising purposes.

BRIEF SUMMARY OF THE INVENTION

Briefly stated, an enclosure is provided for a portable toilet. The portable toilet includes a door through which users can enter and exit the toilet and a base to which the portable toilet is mounted. The enclosure comprises at least two sections, one of which has a door opening and a door hingedly mounted thereon. The enclosure door has a surface shape corresponding to surface of the enclosure, such that the enclosure door will not interfere with the appearance of the enclosure. The enclosure door is moveable between a closed position and an opened position and is provided with a handle to open the door. Preferably, the door is spring biased to a closed position, for example, with a spring hinge. Additionally, a tether can be mounted to an inner surface of the enclosure door and which is can be removably attached to a door of the portable toilet. The tether is sized such that when the portable toilet door is closed, the tether will pull the enclosure door closed.

Each enclosure section includes a first end and a second end. A connector tab having a hole extends from the first end and a wall hole is formed near the second end of each enclosure section. When assembled, the first end of one section abuts the second end of the adjacent section. To ensure a substantially smooth seam or junction between the two sections, in the illustrative embodiment disclosed, the connector tab extends from the inner surface of one section, across the junction between the two sections, to lie against the inner surface of the adjacent section. The tabs are aligned with the holes, and are sized such that the tab holes align with the wall holes in the adjacent section. A fastener is passed through the wall hole and the tab hole to secure the two sections together. Mounting tabs are also provided at the bottom of the enclosure sections to secure the enclosure to the base of the portable toilet. This will positionally fix the enclosure relative to the toilet to maintain alignment of the enclosure door with the door of the portable toilet.

The enclosure can be provided with a top portion which is removably mountable to the enclosure to form an enclosure assembly. The top portion is sized and shaped, such that, when mounted to the enclosure, the enclosure assembly has the appearance of a bottle. The top portion, like the enclosure, comprises a first section and a second section. Each section of the top portion includes a first end and a second end, a connector tab extending from the first end and a fastener near the second end. The connector tab receives the fastener to secure adjacent sections of the top portion together. Like the enclosure, the top portion sections are matable together such that the first end of the first section is in abutment with the second end of the second section such that the outer surfaces of adjacent sections are substantially flush with each other.

To provide light for the portable toilet, the top portion is adapted to allow light to pass through it. The top portion can, for example, be made from a mesh through which light will pass. Alternatively, the top portion can include a plurality of perforations positioned on the top portion so that they are not visible to a person standing on the ground.

To provide a clean and smooth connection from the enclosure to the top portion, the bottom edge of the top portion is shaped correspondingly to the top edge of the enclosure. Preferably, the enclosure has a lip at its top edge, to give the enclosure the appearance of a beverage can when the top portion is not mounted on the enclosure. The top portion thus includes a complementary lip at its bottom edge which sits on the lip of the enclosure top edge.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
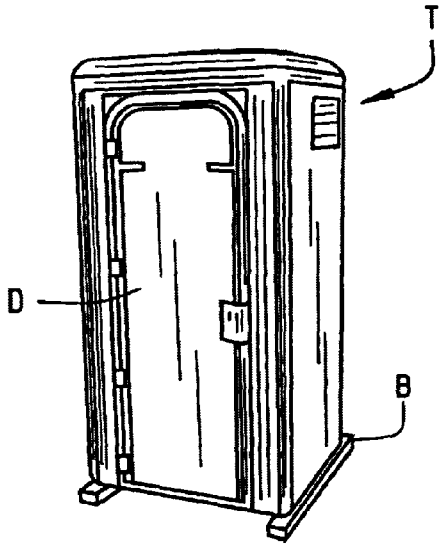
FIG. 1 PRIOR ART
FIG. 1 is a perspective view of a portable toilet.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A typical portable toilet T is shown in FIG. 1. The toilet includes a door D and is mounted on a base B (which is typically made of wood or plastic, but can be made of other materials as well). As is known, toilets T can be quickly installed at desired locations to provide bathroom facilities to, for example, fairgoers.

To enhance the appearance of the portable toilet T, an enclosure or cover 10 can be erected around the toilet T. The enclosure 10 includes two sections 12 and 14 which are connected together. The enclosure sections 12 and 14 are preferably made from a material upon which graphics can be printed. For example, the enclosure sections can be made from fiberglass, plastic, or other material which are easily molded. The ability to print graphics on the enclosure sections allows for the enclosure to be decorated. For example, the graphics can make the enclosure appear to be a large beverage can, with all applicable logos on the can. Or, the graphics can simply provide for a pleasing appearance to the enclosure, and hence, to the portable toilet.

Figure 5:
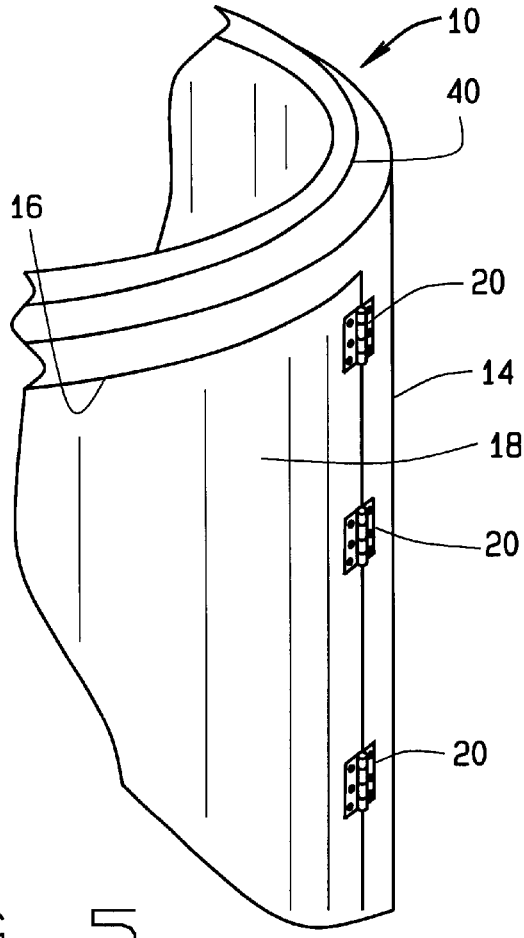
FIG. 5 is an enlarged sectional view showing the hinged door of the enclosure.

The section 12 is solid—that is, its surface is substantially uninterrupted, and it has no windows, doors, or other large openings. The section 14, on the other hand, includes an opening 16 for a door 18., As seen in FIG. 5, the door 18 is secured to the section 14 by hinges 20. The two sections are shown to be semi-circular, and, when connected, define a cylinder. The door 18 is also curved, and has a curvature which corresponds to the curvature of the section 14. When closed, the door 18 is flush with the section 14 to provide a smooth appearance to the enclosure 10. The edge of the door opening 16 can be rabetted to provide a lip against which the door 18 rests when closed, and to define a stop for the door 18. To open the door 18, the door is provided with a handle 19. The door 18 is spring loaded, so that it will close by itself. The spring loading of the door can be accomplished using a spring which extends between the door and the enclosure section 14, or a spring loaded hinge can be used. Additionally, the enclosure can be provided with a magnet along the rabetted edge of the enclosure section 14, and a corresponding magnet can be located on the enclosure door 18. The magnets on the rabetted edge and the door will serve to positively hold the door closed against small forces, such as wind. Thus, the door 18 will not be opened, unless opened by a user. This will maintain the appearance of printing on the outer surface of the enclosure. Preferably, the magnets will be embedded in their respective surfaces, such that when the door 18 is closed, the outer surface of the door will be substantially flush with the outer surface of the enclosure section 14. Additionally, the enclosure door 18 is provided with a rod, cord, or tether 19 (FIG. 6) to connect the enclosure door 18 to the portable toilet door D. The tether 19 is positioned at the top of the doors, so as not to interfere with someone passing between the doors. Additionally, the tether 19 has a length such that when someone uses the portable toilet T and closes the door D, the closing of the door D will pull the enclosure door 18 shut. Further, when the toilet door D is locked, someone else will not be able to open the enclosure door 18.

Figure 3:
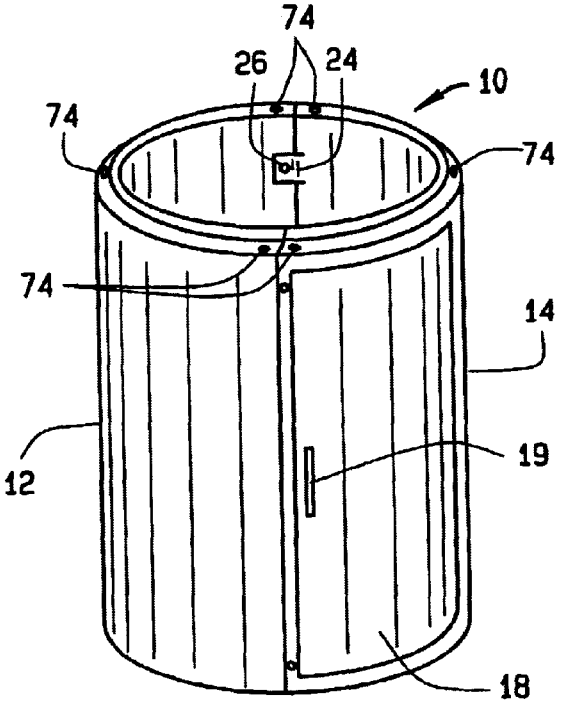
FIG. 3 is a top perspective view of the portable toilet enclosure when assembled.
Figure 4:
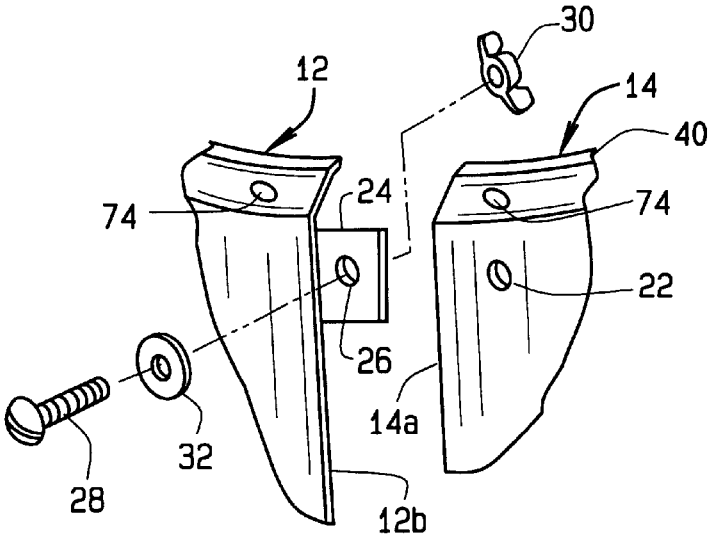
FIG. 4 is an enlarged sectional view showing the attachment of two sections of the enclosure.

Each section 12 and 14 includes opposed ends 12*a*,b and 14*a*,b. Wall holes 22 are formed in the sections near the ends 12*a* and 14*a*. Connector tabs 24 having holes 26 extend from the section ends 12*b* and 14*b*. Preferably the enclosure sections are provided with upper and lower wall holes 22 and connector tabs 24. As best seen in FIGS. 3 and 4, the connector tabs 24 extend from the inner surface of the sections 12 and 14 so as not to interfere with the end edges of the sections. The connector tabs 24 are positioned on the section ends 12*b* and 14*b* to be aligned with the wall holes 22 on the opposing ends 14*a* and 12*a*. The connector tabs 24 are sized,. and the tab holes 26 are positioned, such that the tab holes 26 align with the wall holes 22 in the section ends 12*a* and 14*a* when the two sections are brought together. As seen in FIG. 4, a threaded fastener 28 (such as a bolt or screw) and nut 30 (a wing nut is shown) are used to secure the sections together. A washer 32 can also be provided. In lieu of the nut 30, the tab hole 26 can be threaded. Alternatively, a nut structure having the threaded opening can be formed on the tab 24, or fixed to the tab.

Figure 6:
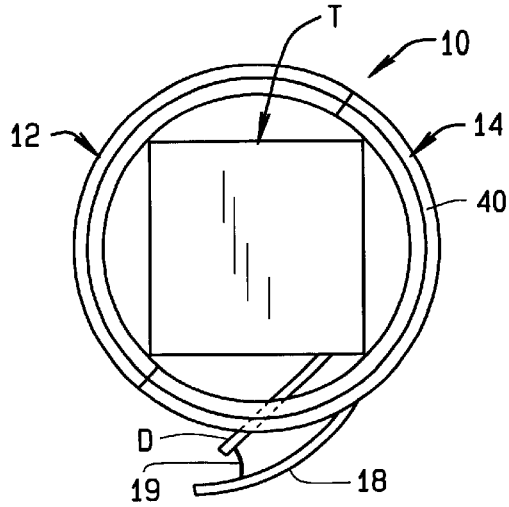
FIG. 6 is a top plan view of the enclosure surrounding a portable toilet, and with the doors of the portable toilet and enclosure shown opened.

To assemble the enclosure 10, the sections are brought together such that their opposing ends abut each other. Section end 12*a* abuts section end 14*b*, and section end 12*b* abuts section end 14*a*. The connector tab 24 will then extend from the inner surface of one section to the inner surface of the other section, as seen in FIG. 3, and the tab opening 26 will be aligned with the opening 22. The fastener 28 is then passed through the hole 22 and the tab hole 26. The washer 32 can be applied to the fastener first, so that the washer 32 is on the outer surface of the enclosure 10. The nut 30 is then threaded onto the fastener from the inside of the enclosure 10. A wing nut is shown in the drawings because of the ease of use of wing nuts. However, any type of nut can be used. As can be appreciated, if the nut 30 is fixed to or formed on the tab, or the tab hole 26 is threaded, then assembly of the enclosure 12 can be accomplished totally from the outside of the enclosure. As seen, four connector tabs are provided (two on each section). Thus, the enclosure sections 12 and 14 can be assembled together very quickly and with very little effort. As seen in FIG. 6, when the enclosure 10 is assembled, it will surround the portable toilet building T.

As noted, the tabs 24 extend from the inner surface of the sections 12 and 14, the section edges, which are shaped complimentary to each other. Thus, the opposed section edges can abut each other along the length of the section edges. This allows for the section edges to be in close abutment and provides for an appearance of a continuous cylindrical surface, when viewed from a distance.

Figure 2:
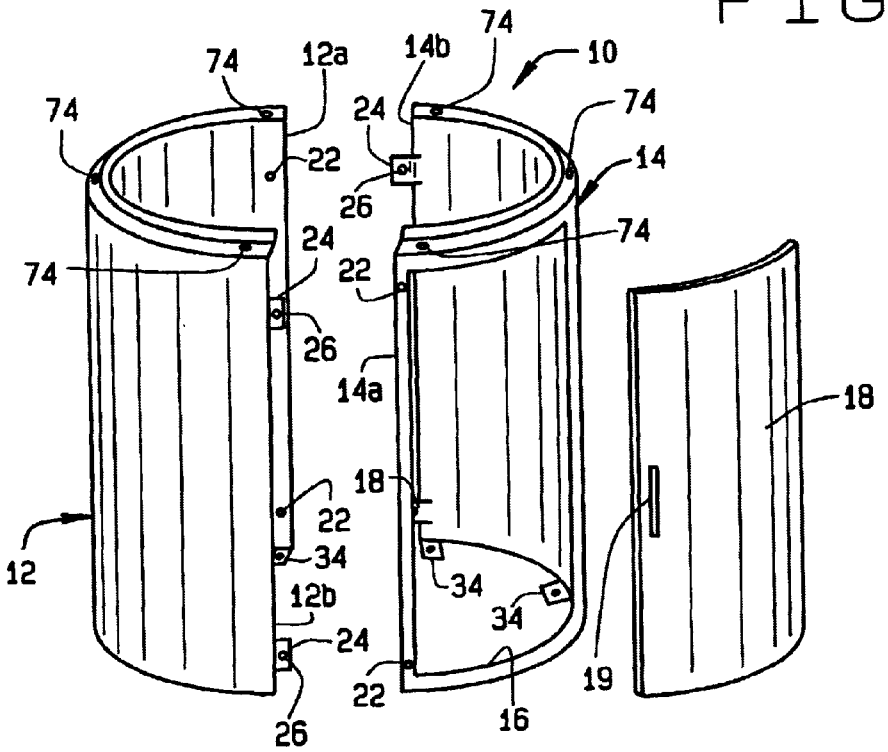
FIG. 2 is an exploded perspective view of a portable toilet enclosure which can be assembled around the portable toilet of FIG. 1.

The enclosure sections 12 and 14 also include mounting tabs 34 (FIG. 2) which extend inwardly from the bottom of the sections 12 and 14 to be near the base B of the portable toilet T. The mounting tabs also include holes through which fasteners extend to secure the sections to the wooden base B on which the toilet T is mounted. The tabs are used to secure the enclosure 10 to the base around the toilet and to prevent movement of the enclosure 10 relative to the portable toilet T. When the enclosure 10 is used, the door of the portable toilet is left in place. As can be appreciated, the enclosure 10 is mounted about the portable toilet T such that the enclosure door 18 is substantially aligned with the portable toilet door D. The use of the mounting tabs 34, this will maintain alignment of the enclosure door 18 with the toilet door D. To allow for easy access to the mounting tabs 38, the tabs 38 are preferably positioned near the door opening 16.

In a preferred embodiment of the enclosure, the sections 12 and 14 are semicircular, such that when assembled, they form a cylinder. As shown in FIG. 6, the enclosure 10 has a diameter that is not much greater than the greatest dimension of the toilet T (i.e., the diagonal dimension of the toilet T). Hence, the enclosure will fit fairly snuggly around the portable toilet T. A typical portable toilet is 42"×42". Thus, the inner diameter of the enclosure 10, when assembled is about 63" (which is about 4" greater than the diagonal measurement of the toilet T). Thus, there is a small gap between the corners of the portable toilet T and the inner surface of the enclosure. This size of the enclosure 10 will not interfere with vents of the portable toilet T. Additionally, so as not to interfere with the roof of the portable toilet T, which is often relied upon to provide light for the interior of the toilet T, the enclosure 10 is not closed at its top, and natural light can pass through the top of the portable toilet to provide light for a user of the toilet.

A lip 40 is formed at the top of the enclosure sections. The lip 40 is formed to give the enclosure the appearance of, for example, a soft drink or beer can. A beverage manufacturer can then have graphics applied to the smooth outer surface of the enclosure so that the enclosure resembles a can of the soft drink or beer.

The enclosure sections preferably subtend the same degree of arc. Thus, the two sections preferably both extend for about 180°. Because the sections 12 and 14 are of the same size, they can be nested together for transportation to and from, for example, a fair ground, where they are to be assembled around portable toilets, and disassembled when the portable toilets are to be removed from the fair grounds. The enclosure can be made from any desired material. However, the enclosures are preferably made from a fiberglass, plastic, rigid foam, or other material which is easily molded and to which graphics can be easily applied.

Figure 7:
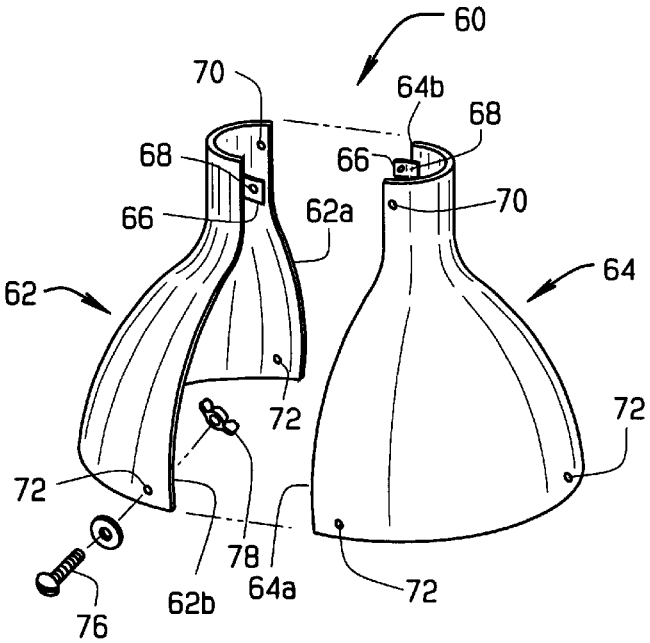
FIG. 7 is an exploded view showing a top enclosure which can be secured to the cylindrical enclosure of FIG. 3 to provide a bottle shaped enclosure.
Figure 8:
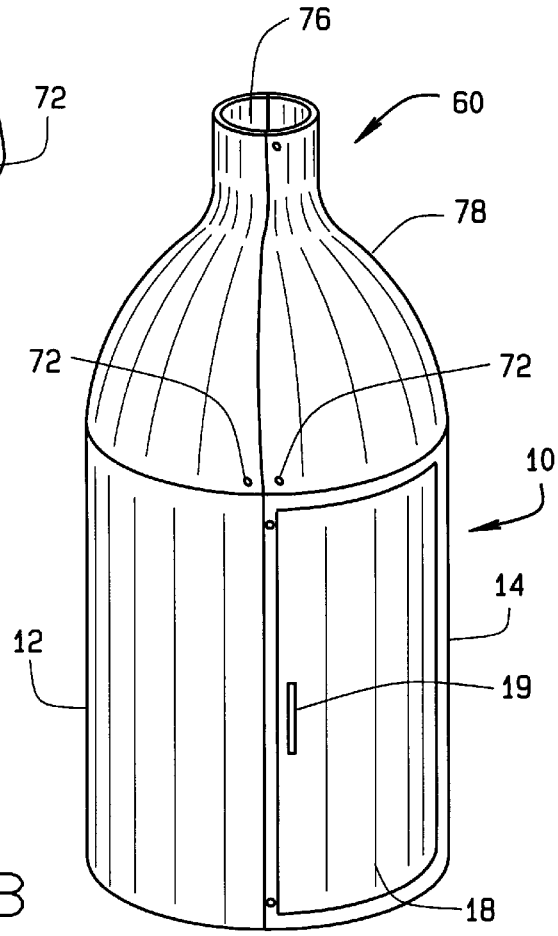
FIG. 8 is a perspective view of the enclosure with the top assembled onto the cylindrical portion.

A top enclosure 60 (FIGS. 7 and 8) can be provided and secured to the enclosure 10 to give the enclosure assembly the appearance of a beverage bottle. The cover 60, like the enclosure 10, comprises two portions 62 and 64, each of which have end edges 62*a*,b and 64*a*,b. The edges 62*b* and 64*b* are provided with connector tabs 66 having holes 68. The connector tabs 66 are substantially similar to the connector tabs 24, and will not be further described. The opposite edges 62*a* and 64*a* are provided with openings 70. As with the connector tabs 24, the connector tabs 66 preferably extend from the inner surface of the cover sections 62 and 64 such that the end edges 62*b* and 64*b* are uninterrupted. This will enable a close abutment of the edge 62*a* with the edge 64*b*, and the edge 62*b* with the edge 64*a*, so that any gap between the edges of the two top enclosure sections will be minimized. The tabs 66 are sized and positioned, and the openings 70 are positioned, such that when the cover sections 62 and 64 are brought together, the tab holes 68 will be aligned with the openings 70. A threaded fastener (not shown) is passed through the two aligned openings, and a nut is threaded onto the fastener to hold the two sections together to form the cover. Each section is shown with a single connector tab 66, however, the sections 62 and 64 could be provided with additional connector tabs, if desired. In lieu of the nut, the tab hole 68 can be threaded. Alternatively, a nut structure having the threaded opening can be formed on the tab 66, or fixed to the tab.

To secure the cover 60 to the enclosure 10, the cover sections 62 and 64 are provided with openings 72 near the bottom of the sections. Additionally, the enclosure sections 12 and 14 are provided with openings 74 in the shoulder 40. The cover openings 72 and the enclosure openings 74 are positioned to be aligned with each other when the cover sections are placed on the enclosure. A fastener 76 is passed through the aligned openings 72 and 74, and a nut 78 is threaded onto the fastener at the inner surface of the cover and enclosure sections. The sections 12, 14, 62, and 64 are shown with three openings 74 and 72 (each near one of the edges of the sections, and one approximately midway between the edges), however, fewer or more openings could be provided, as desired. Instead of using a nut, the enclosure openings 74 could be internally threaded. Additionally, the base of the top enclosure sections 62 and 64 are shaped to correspond to the shoulder 40 of the enclosure sections 12 and 14. Thus, the cover 60 will sit on the enclosure shoulder 40, and the enclosure shoulder will support the cover. Additionally, the outer surface of the top enclosure 60 will be substantially flush with the outer surface of the enclosure 10, and, any gap between the top enclosure 60 and the bottom enclosure 10 will be minimized.

The cover 60 can be assembled and then secured to the already assembled enclosure. Alternatively, the cover section 62 can be assembled to the enclosure section 12, and the cover section 64 can be assembled to the enclosure section 14, and then the two assemblies can be assembled together to form the complete bottle-shaped enclosure. As noted above, the portable toilet T relies on light coming in through the roof of the toilet to provide lighting for the toilet. The cover 64 is opened at least at its top, as at 76 to allow light in through the top of the cover 64. Additionally, the upper curved portion 78 can be provided with perforations, through which light can pass. This part of the cover is not visible to people on the ground, and thus, such perforations would not interfere with the overall appearance with any graphics applied to the cover 60. Alternatively, the top enclosure 60 can be made from a mesh upon which graphics can be printed. The mesh will preferably be sized such that light can pass through the mesh, yet, the graphics printed on the mesh will appear to be complete (i.e. openings in the graphics from the mesh will not be visible).

As various changes could be made in the above constructions without departing from the scope of the invention, it is intended that all matter contained in the above description or shown in the accompanying drawings shall be interpreted as illustrative and not in a limiting sense. Other types of fasteners, other than bolts or screws could be used to assemble the two sections together. For example, a keyhole slot could be formed on the tab, and the adjacent section could include a pin which is received in the slot. In this case, the pin would form this fastener, and would avoid the need for a screw fastener. A slot could be formed in the edges 12*a*and 14*a*, and the connecting tabs 22 could extend directly from the edge to be received in the edge slot of the adjacent section. Such a construction would still allow for a close and smooth junction between the two sections. Although two sections are shown, the enclosure could be made from more than two sections. These examples are merely illustrative.

What is claimed is:

1. An enclosure for surrounding a portable toilet building having front, back, and side walls, the enclosure comprising at least two sections, one of said sections having a door opening and a door mounted thereon, the door being moveable between a closed position and an opened position; each section including a first end and a second end, a connector tab extending from said first end and a fastener near said second end; said connector tab receiving said fastener to secure adjacent sections of said enclosure together; said sections being matable together such that the first end of one section is in abutment with the second end of the other section such that the outer surfaces of adjacent sections are substantially flush with each other; said first and second sections being sized such that when said first and second sections are connected, said first and second sections will define an enclosure which surrounds the portable toilet building.

2. The enclosure of claim 1 wherein said enclosure includes a wall hole near said section second ends, said connector tab including a hole, said connector tab being sized and positioned such that said connector tab hole is aligned with said wall hole when adjacent sections abut each other; said fastener comprising a threaded fastener which extends through said wall hole and into said connector tab hole.

3. The enclosure of claim 1 wherein said connector tabs extend from an inner surface of said sections such that said edge at said section first end is substantially uninterrupted.

4. The enclosure of claim 1 including a mounting tab extending inwardly at a bottom of said enclosure, said mounting tab being positioned and sized to accept a fastener to mount said enclosure to a base of said portable toilet.

5. The enclosure of claim 1 wherein said enclosure door has a contour conforming substantially to the contour of said section to which said door is mounted; said door having an outer surface which, when said door is closed, is substantially flush with the outer surface of said enclosure section.

6. The enclosure of claim 1 wherein said door is spring biased to a closed position.

7. The enclosure of claim 1 including a tether mounted to an inner surface of said enclosure door, said tether being sized to be removably attached to a door of said portable toilet building, such that when said portable toilet door is closed, said tether will pull said enclosure door closed.

8. The enclosure of claim 1 wherein said enclosure is provided with a lip at the top of said enclosure to give the enclosure the appearance of a beverage can.

9. The enclosure of claim 1 including a top portion which is removably mountable to said enclosure to form an enclosure assembly, said top portion being sized and shaped, such that, when mounted to said enclosure, said enclosure assembly has the appearance of a bottle.

10. The enclosure of claim 9 wherein said top portion is adapted to allow light to pass through said top portion.

11. The enclosure of claim 10 wherein said top portion is made from a mesh.

12. The enclosure of claim 10 wherein said top portion includes a plurality of perforations, said perforations being positioned on said top portion such that said perforations are not visible to a person standing on the ground.

13. The enclosure of claim 9 wherein said top portion sections have bottom edges, and said enclosure sections have top edges; said top portion section bottom edges being shaped correspondingly to said enclosure section top edges.

14. The enclosure of claim 13 wherein said enclosure top edge includes a shoulder, and said top portion bottom edge includes a shoulder, said top portion shoulder facing said bottom portion shoulder, such that said shoulders of said enclosure and said top portion engage each other.

15. An enclosure for a portable toilet building, the portable toilet building comprising front, back, and side walls, a door in said front wall, and a base on which the portable toilet building is mounted; the enclosure comprising:

at least two sections; to form said enclosure, said enclosure being sized to surround said portable toilet building; one of said sections having a door opening and an enclosure door mounted thereon, said enclosure door being positioned to be generally aligned with the door of the portable toilet building, the enclosure door being moveable between a closed position and an opened position; each section including a first end and a second end;

a connecting tab extending from the first end of each section and a wall hole near the second end of each section; said connecting tab having a hole; said connecting tabs extending from an inner surface of said sections such that said edge at said first end is substantially uninterrupted;

said sections being matable together such that the first end of one section is in abutment with the second end of the other section; said connecting tab being of sufficient length such that said tab hole of one section is aligned with the hole of the adjacent section; said enclosure including a fastener which extends through said wall hole and at least into said tab hole to secure said sections together to form said enclosure.

16. The enclosure of claim 15 wherein said enclosure includes at least one mounting tab extending inwardly at a bottom of said enclosure, said mounting tab extending over said base being positioned and sized to accept a fastener which passes through said mounting tab and into said base to positionally fix said enclosure to said base.

17. The enclosure of claim 15 wherein said enclosure door has a contour conforming substantially to the contour of said section to which said door is mounted; said door having an outer surface which, when said door is closed, is substantially flush with the outer surface of said enclosure section.

18. An enclosure for a portable toilet, the enclosure comprising:

at least two sections, one of said sections having a door opening and a door mounted thereon, the door being moveable between a closed position and an opened position, each section including a first end and a second end, a connector tab extending from said first end and a fastener near said second end; said connector tab receiving said fastener to secure adjacent sections of said enclosure together; said sections being matable together such that the first end of one section is in abutment with the second end of the other section such that the outer surfaces of adjacent sections are substantially flush with each other; and a top portion which is removably mountable to said enclosure to form an enclosure assembly, said top portion being sized and shaped, such that, when mounted to said enclosure, said enclosure assembly has the appearance of a bottle; said top portion comprising a first section and a second section; each section including a first end and a second end, a connector tab extending from said first end and a fastener near said second end; said connector tab receiving said fastener to secure adjacent sections of said top portion together; said top portion sections being matable together such that the first end of said first section is in abutment with the second end of the second section such that the outer surfaces of adjacent sections are substantially flush with each other.

19. An enclosure for a portable toilet, the portable toilet having a door and a base on which the portable toilet is mounted; the enclosure comprising:

at least two sections, one of said sections having a door opening and a door mounted thereon, the door being moveable between a closed position and an opened position: each section including a first end and a second end;

a connecting tab extending from the first end of each section and a wall hole near the second end of each section; said connecting tab having a hole; said connecting tabs extending from an inner surface sections such that said edge at said first end is substantially uninterrupted;

said sections being matable together such that the first end of one section is in abutment with the second end of the other section; said connecting tab being of sufficient length such that said tab hole of one section is aligned with the hole of the adjacent section; said enclosure including a fastener which extends through said wall hole and at least into said tab hole to secure said sections together to form said enclosure;

said enclosure further including a top portion which is removably mountable on said enclosure to form an enclosure assembly, said top portion being sized and shaped, such that, when mounted to said enclosure, said enclosure assembly has the appearance of a bottle;

said enclosure including a top edge, said top edge having an opening in said top edge said top portion comprising a first section and a second section; each section including a first end, a second end, and a bottom edge, a connector tab extending from said first end, a fastener near said second end, and a mounting opening near said top portion bottom edge;

said top portion mounting opening being alignable with said enclosure top edge opening; said enclosure assembly including a fastener which extends through said top portion mounting hole and said enclosure top edge opening to secure said top portion to said enclosure;

said top portion connector tab receiving said fastener to secure adjacent sections of said top portion together; said top portion sections being matable together such that the first end of said first section is in abutment with the second end of the second section such that the outer surfaces of adjacent sections are substantially flush with each other.

20. An enclosure for the a portable toilet building, the portable toilet building having front, back, and side walls, and a door in its front wall; the enclosure comprising:

at least two sections which are matable together to form said enclosure; said enclosure being sized to surround said portable toilet building, one of said sections having a door opening and a door hingedly mounted thereon, the door being moveable between a closed position and an opened position; each section including a first end, a second end, an inner surface and an outer surface;

a connecting tab having a hole extending from said first end of each section and a wall hole near said second end of each section; said connecting tabs and wall holes being positioned, such that when the first end of one section abuts the second end of a second section, said tab hole is aligned with said wall hole; said connecting tabs extending from an inner surface sections such that said edge at said first end is substantially uninterrupted;

a fastener which extends through said wall hole and at least into said tab hole to secure said sections together to form said enclosure;

the outer surfaces of said adjacent sections being substantially flush; and said enclosure door having a contour conforming substantially to the contour of said section to which said door is mounted; said door having an outer surface which, when said door is closed, is substantially flush with the outer surface of said enclosure section, such that, said enclosure, when assembled, has a substantially smooth outer surface.

* * * * *